US006659846B2

(12) United States Patent
Misra et al.

(10) Patent No.: US 6,659,846 B2
(45) Date of Patent: Dec. 9, 2003

(54) PAD FOR CHEMICAL MECHANICAL POLISHING

(75) Inventors: Sudhanshu Misra, Orlando, FL (US); Pradip Kumar Roy, Orlando, FL (US)

(73) Assignee: Agere Systems, Inc., Allentown, PA (US)

( * ) Notice: Subject to any disclaimer, the term of this patent is extended or adjusted under 35 U.S.C. 154(b) by 84 days.

(21) Appl. No.: 09/954,341

(22) Filed: Sep. 17, 2001

(65) Prior Publication Data

US 2003/0054735 A1 Mar. 20, 2003

(51) Int. Cl.[7] ..... B24B 7/00
(52) U.S. Cl. ..... 451/41; 451/57; 451/285
(58) Field of Search ..... 451/41, 57, 285–290, 451/526, 527, 529, 539, 443, 444

(56) References Cited

U.S. PATENT DOCUMENTS

| | | | | |
|---|---|---|---|---|
| 5,287,663 | A | * 2/1994 | Pierce et al. | 451/539 |
| 5,356,513 | A | * 10/1994 | Burke et al. | 438/633 |
| 5,421,769 | A | * 6/1995 | Schultz et al. | 451/287 |
| 5,435,772 | A | * 7/1995 | Yu | 451/63 |
| 5,441,598 | A | * 8/1995 | Yu et al. | 438/692 |
| 5,453,312 | A | * 9/1995 | Haas et al. | 428/143 |
| 5,468,682 | A | * 11/1995 | Homma | 438/633 |
| 5,503,592 | A | * 4/1996 | Neumann | 451/278 |
| 5,510,652 | A | * 4/1996 | Burke et al. | 257/752 |
| 5,516,729 | A | * 5/1996 | Dawson et al. | 438/623 |
| 5,525,191 | A | * 6/1996 | Maniar et al. | 438/693 |
| 5,527,424 | A | * 6/1996 | Mullins | 438/692 |
| 5,607,341 | A | 3/1997 | Leach | |
| 5,624,303 | A | * 4/1997 | Robinson | 451/285 |
| 5,725,417 | A | * 3/1998 | Robinson | 451/56 |
| 5,738,567 | A | * 4/1998 | Manzonie et al. | 451/41 |
| 5,738,574 | A | 4/1998 | Tolles et al. | |
| 5,782,675 | A | 7/1998 | Southwick | |
| 5,904,615 | A | 5/1999 | Jeong et al. | |
| 5,919,082 | A | 7/1999 | Walker et al. | |
| 5,972,792 | A | 10/1999 | Hudson | |
| 6,069,080 | A | 5/2000 | James et al. | |
| 6,135,859 | A | 10/2000 | Tietz | |
| 6,136,138 | A | 10/2000 | Yagisawa | |
| 6,206,756 | B1 | 3/2001 | Chopra et al. | |
| 6,217,426 | B1 | 4/2001 | Tolles et al. | |
| 6,234,877 | B1 | 5/2001 | Koos et al. | |
| 6,241,587 | B1 | 6/2001 | Drill et al. | |
| 6,241,596 | B1 | 6/2001 | Osterheld et al. | |

OTHER PUBLICATIONS

Rodel DiaGrid Pad Conditioners, The Ideal Solution for CMP. Rodel, Inc., 2000.

Chemical Mechanical Polishing. http://www–mtl.edu/`dwhite/cmp.htm.

* cited by examiner

*Primary Examiner*—Joseph J. Hail, III
*Assistant Examiner*—Anthony Ojini
(74) *Attorney, Agent, or Firm*—David G. Maire; Beusse Brownlee Bowdoin & Wolter, P.A.

(57) ABSTRACT

An improved polishing pad (22) for use in a chemical mechanical polishing (CMP) operation as part of a semiconductor device fabrication process. The polishing pad is formed of a plurality of particles of abrasive material (24) disposed in a matrix material (26). The abrasive particles may be a stiff inorganic material coated with a coupling agent, and the matrix material may be a polymeric material such as polyurethane. As the polishing pad wears through repeated polishing operations, the newly exposed polishing surface will contain fresh abrasive particles and will exhibit the same polishing properties as the original surface, thereby providing consistent polishing performance throughout the life of the pad without the need for conditioning operations. In one embodiment the distribution of particles of abrasive material per unit volume of matrix material may vary from one portion (23) of the pad to another (25).

20 Claims, 2 Drawing Sheets

PAD FOR CHEMICAL MECHANICAL POLISHING

FIELD OF THE INVENTION

This invention relates generally to the field of semiconductor device fabrication, and more particularly to the field of chemical mechanical polishing of semiconductor wafers, and specifically to an improved polishing pad for chemical mechanical polishing of a semiconductor wafer.

BACKGROUND OF THE INVENTION

The fabrication of microelectronics devices involves the deposition and removal of multiple layers of material on a semiconductor substrate to form active semiconductor devices and circuits. Device densities currently exceed 8 million transistors per square centimeter, and they are expected to increase by an order of magnitude within the next decade. Such devices utilize multiple layers of metal and dielectric materials which can selectively connect or isolate device elements within a layer and between layers. Integrated circuits using up to six levels of interconnects have been reported and even more complex circuits are expected in the future. Device geometries have gone from 0.5 micron to 0.12 micron and will soon be 0.08 micron. Multi-levels of metallization are required in such devices to achieve the desired speeds, and each inter-metal level must be planarized during the manufacturing process. The only known process with the ability to create a sufficiently planar surface is chemical mechanical polishing (CMP). CMP may be used to remove high topography and/or to remove defects, scratches or embedded particles from the surface of a semiconductor wafer as part of the manufacturing process.

The CMP process generally involves rubbing a surface of a semiconductor wafer against a polishing pad under controlled pressure, temperature and rotational speed in the presence of a chemical slurry. An abrasive material is introduced between the wafer and the polishing pad, either as particles affixed to the polishing pad itself or in fluid suspension in the chemical slurry. The abrasive particles may be, for example, alumina or silica. The chemical slurry may contain selected chemicals which function together with the abrasive to remove a portion of the surface of the wafer in a polishing action. The slurry also provides a temperature control function and serves to flush the polishing debris away from the wafer.

As may be seen in FIG. 1, a chemical mechanical polishing system 10 may include a carrier 12 for holding and moving a semiconductor wafer 14 against a polishing pad 16 supported on a rotatable platen 18. A slurry 20 is used to provide the desired chemical interaction and abrasion when the wafer 14 is pressed and rotated against the polishing pad. As is known in the art, the rate of material removal from the wafer 14 will depend upon many variables, including the amount of force F exerted between the wafer 14 and the polishing pad 16, the speeds of rotation $R_1$ of the carrier and $R_2$ of the platen, the transverse location of the carrier 12 relative to the axis of rotation of the platen 18, the chemical composition of the slurry 20, the temperature, and the composition and history of use of the polishing pad 16. Numerous configurations of CMP machines are known and are available in the industry. One manufacturer of such CMP machines is Applied Materials, Inc. of Santa Clara, Calif. (www.appliedmaterials.com)

It is known in the art that polishing pads 16 may be made of various materials and compositions. One or more layers of material may be used to form a polishing pad. For example, one style of polishing pad includes both a rigid pad layer in contact with the wafer and a compliant pad layer underlying the rigid pad layer. In one example, a cast polyurethane pad is backed by a polyester felt pad stiffened with polyurethane resin. Other pads having various material compositions are known and are available in the industry. One manufacturer of prior art polishing pads is Rodel, Inc. of Phoenix, Ariz. (www.rodel.com) Polishing pads are known to have a porous surface that interacts with the wafer surface in the presence of the slurry to provide the necessary material removal for the polishing process. The porous surface will capture the micro particles of wafer materials that are removed during the CMP process. It is well known that as a polishing pad is used, the porous surface of the pad will gradually become clogged with particles and the rate of removal of wafer material will decrease with use. Yet another style of polishing utilizes a fixed abrasive pad wherein, as the name suggests, abrasive material is fixed on the surface of a polishing pad. A fixed abrasive pad will accumulate debris between the abrasive particles as it is used, and the hard mineral particles used as the abrasive will wear and may become dislodged from the pad surface. Such changes reduce the rate of material removal and cause the polishing performance to be non-reproducible from wafer to wafer. Once the material removal rate has dropped to a predetermined value, a fixed abrasive pad must be replaced and a porous surface pad must be conditioned to restore its full functionality. Pad conditioning is a integral part of prior art CMP processes. Pad conditioning may be performed by exposing the polishing pad to a sonically agitated stream of fluid with or without chemical additive, or it may be performed by rubbing a hard abrasive surface against the polishing pad to remove embedded debris and to restore a desired degree of roughness and porosity to the polishing pad surface. Pad conditioners may be metal plates having industrial diamonds affixed to their surface. Rodel, Inc. is one supplier of pad conditioners to the semiconductor manufacturing industry. In a typical CMP operation, a polishing pad may have to be conditioned after polishing only one or a few wafers. Conditioning requires that the carrier 12 be moved to a conditioning position or station, and it may consume from 5–60 seconds of critical path time during the fabrication process. During the conditioning operation, the polishing pad and its associated carrier are not available for CMP operations, thus impacting the overall productivity of a semiconductor manufacturing line. Under even the best circumstances, it is unusual to be able to perform more than ten polishing operations between conditioning operations. Pads must be replaced after polishing from 350–1,000 wafers, depending upon the polishing parameters. Accordingly, a more efficient CMP process is needed wherein the critical path time spent conditioning a polishing pad is reduced.

SUMMARY OF THE INVENTION

An improved polishing pad for a chemical mechanical polishing process is described herein as including a plurality of particles of abrasive material disposed in a matrix material. This is referred to as an embedded abrasive pad, wherein the matrix material may be a polymeric material such as polyurethane and the abrasive material may be an inorganic material such as silica, calcium carbonate, alumina silicate, feldspar, calcium sulfate, glass or sintered carbon. The matrix can be visualized as a three-dimensional grid in which the distribution of particles of abrasive material per unit volume of matrix material may be constant throughout the pad, or it may vary from a first portion of the pad to a second portion of the pad. In one embodiment, an edge portion of a polishing pad may contain fewer or more abrasive particles, thereby serving to better control the polishing performance across the pad diameter. As the polishing surface of this improved pad wears during wafer polishing operations, a new surface containing a fresh population of abrasive particles will be exposed, thereby maintaining polishing performance consistent from wafer to wafer. In this manner, as many as 100–500 polishing operations may be accomplished without the need for conditioning of the pad.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 2:
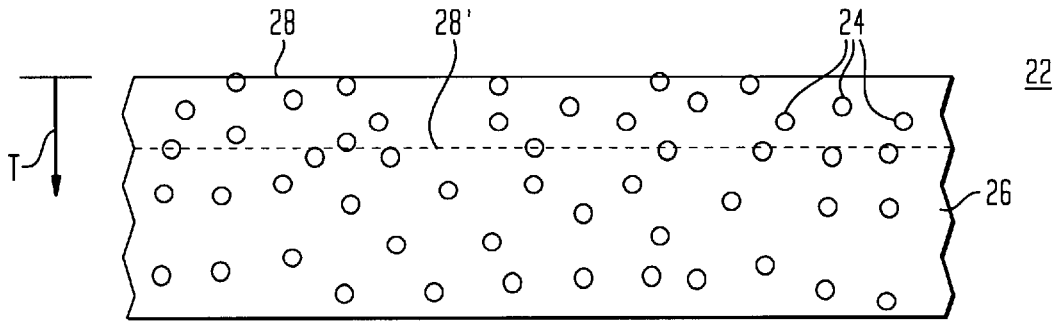
FIG. 2 is a partial cross-sectional view of a polishing pad having abrasive particles embedded in a matrix material.

FIG. 2 is a partial cross-sectional view of a polishing pad 22 having a plurality of abrasive particles 24 embedded in a matrix material 26. Polishing pad 22 provides a desired degree of roughness and hardness for accomplishing a wafer polishing operation regardless of the state of wear of the polishing pad 22. As can be seen from FIG. 2, abrasive particles 24 are distributed throughout a thickness T of the polishing pad 22 within a matrix material 26. Although viewed in two dimensions in FIG. 2, one may appreciate that the matrix material 26 defines a three-dimensional micro-grid or mesh for supporting a three-dimensional array of abrasive particles 24. As polishing surface 28 is used to polish one or more semiconductor wafers, a top portion of the matrix material 26 and some of the uppermost abrasive particles 24 will be worn away, thereby reducing the thickness T of the pad 22. As T is reduced, a different population of abrasive particles 24 will become exposed at the newly exposed polishing surface 28'.

Figure 3:
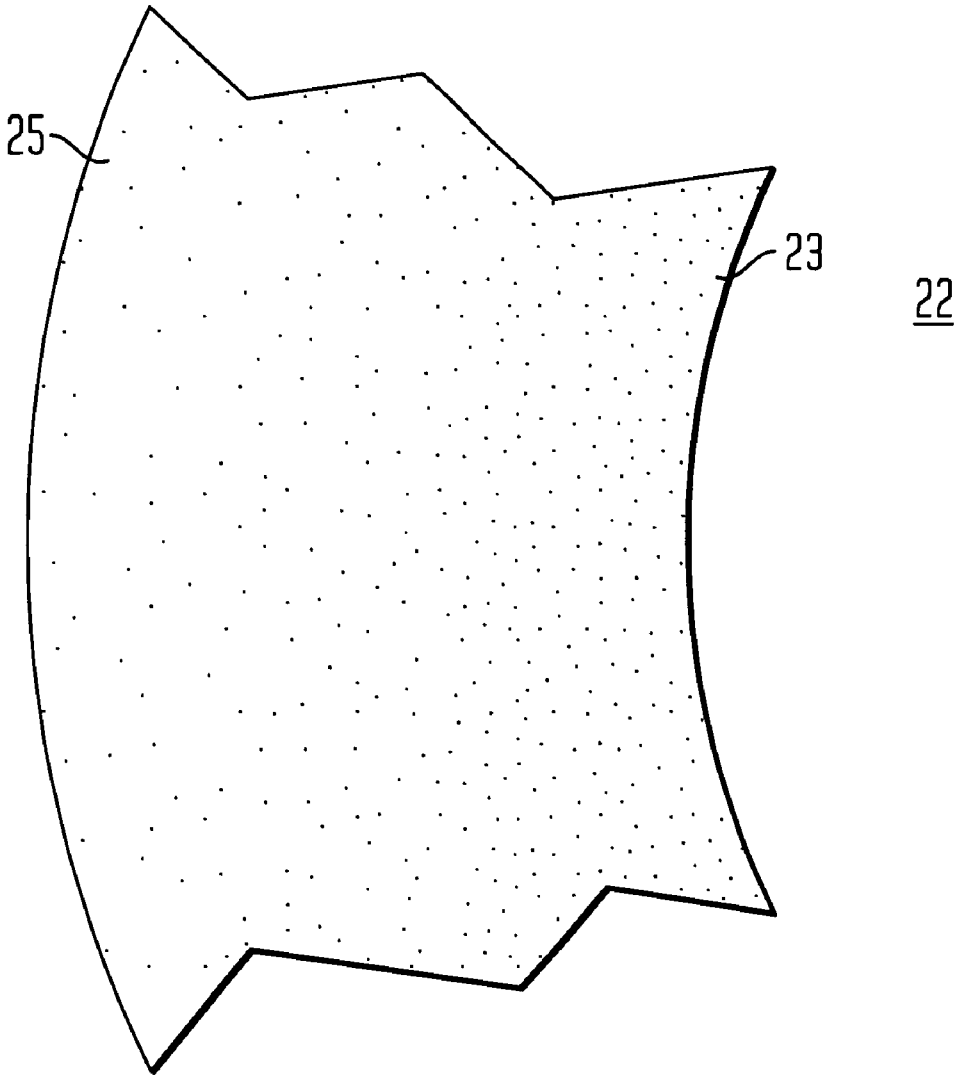
FIG. 3 is a partial top view of the polishing pad of FIG. 2.

The abrasive particles 24 are selected to provide a desired degree of polishing action considering the materials to be removed and the desired surface finish. Stiff inorganic particles may be selected, for example, silica, calcium carbonate, alumina silicate, feldspar, calcium sulfate, glass or sintered carbon. For a typical semiconductor polishing operation, the particle size must be very small to achieve the desired degree of smoothness, for example on the order of $10^{-9}$ meters, such as a range of 50–200 microns. Particles 24 may be distributed evenly or randomly throughout the matrix material 26 in order to provide consistent polishing properties across the thickness T of the pad 22. Alternatively, a systematic array of abrasive particles 24 may be may be desired, with variations in the distribution of the particles 24 possible through the thickness T or across a diameter of the polishing surface 28. FIG. 3 illustrates a partial top view of such an uneven distribution wherein pad 22 has more particles per unit volume toward a center area 23 of the polishing pad 22 and less particles per unit volume toward an edge area 25 in order to counteract an edge effect. In another embodiment, there may be more abrasive particles per unit volume of matrix material as a function of the pad depth T. The number of particles per unit volume may be selected in conjunction with the specification of the other pad properties in order to achieve a desired material removal performance for a particular application. It would be expected that the weight percentage of abrasive particles in the pad may be of the same order of magnitude as the weight percentage of the abrasives in a prior art abrasive slurry, for example 5–40% and preferably 10–25%. The abrasive particles 24 may be treated with a surface chemical coupling agent, such as organo-silicates, organo-titanates, organo-zirconates, etc. to enhance adhesion to the matrix material 26.

The matrix material 26 may be a bulk polymer, for example, polyurethane, poly alkyd (alcohol plus acid), poly vinylester, epoxy, or polyester. The matrix material 26 may be selected to have a desired degree of elasticity, porosity, density, hardness, etc. in order to provide predetermined polishing and wear performance in conjunction with the selected abrasive particles 24.

Figure 1:
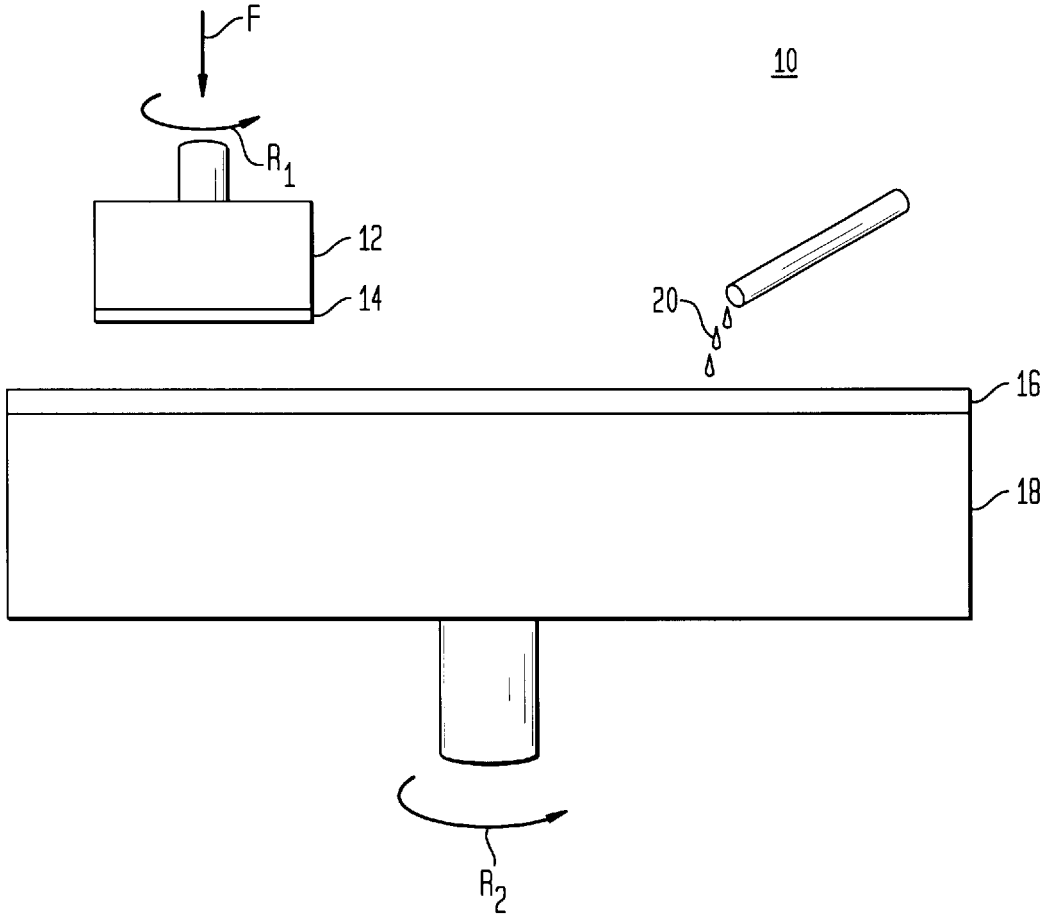
FIG. 1 (PRIOR ART)
FIG. 1 is a schematic illustration of a prior art chemical mechanical polishing system.

Polishing pad 22 may be used to replace the prior art polishing pad 14 in the prior art CMP system illustrated in FIG. 1. Polishing pad 22 may be used with a fluid slurry 20 for temperature and chemistry control and debris removal but without abrasives suspended in the slurry 20. Alternatively, a polishing process utilizing polishing pad 22 may include one step wherein an abrasive is introduced with slurry 20 and a second step wherein no abrasive is included in the slurry 20. Any other element of the composition of the slurry 20 may be changed from a first period of polishing to a second period of polishing, such as a chemical additive or the temperature of the slurry. Such a multi-step process may be used to provide distinct material removal rates during different portions of a polishing process, such as when a first, faster rate of material removal is used to achieve a desired level of planarity, then a second, slower rate of material removal is used to achieve a desired surface finish.

The CMP system 10 of FIG. 1 may be operated without a conditioning step when the prior art polishing pad 14 is replaced by the embedded particle polishing pad 22. As the polishing pad 22 is used, the wear surface 28 will recede into the thickness of the pad 22, removing some of the abrasive particles 24 and matrix material 26. However, the newly exposed surface 28', indicated by the dashed line in FIG. 2, will contain a fresh population of abrasive particles and exhibit the same polishing properties as the original surface 28. The polishing performance properties are thus uniform throughout the life of the pad 22 without the need for conditioning operations. In one embodiment, the original thickness of the pad 22 may be 0.050–0.150 inches and the pad may be used until its thickness is reduced to about 0.015–0.025 inches. During the useful life of such a pad, it would be expected that approximately 100–250 conditioning operations would be eliminated when compared to prior art polishing pads, thereby saving approximately 60–90 minutes of critical path processing time per pad. Such performance would require pad changes no more often than for prior art porous surface pads.

Polishing pad 22 may be manufactured by methods well known in the art, such as with sintering/powder metallurgy, injection molding, or molding/baking/cutting. To achieve a pad having a variable density of abrasive particles per unit volume at different locations on the pad, it may be preferred to utilize a dry sintering/powder metallurgy process, as the distribution of abrasive particles could be controlled as the powders are mixed and applied.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A polishing pad for a semiconductor chemical mechanical polishing apparatus comprising a three-dimensional array of particles of abrasive material disposed in a three-dimensional grid of a matrix material, the particles comprising an inorganic material coated with a coupling agent.

2. The polishing pad of claim 1, wherein the matrix material comprises a polymeric material and the abrasive material comprises an inorganic material.

3. The polishing pad of claim 1, wherein the matrix material comprises polyurethane.

4. The polishing pad of claim 1, wherein the coupling agent is one of the group of organo-silicates, organo-titanates, and organo-zirconates.

5. The polishing pad of claim 1, wherein the distribution of particles of abrasive material per unit volume of matrix material varies from a first portion of the pad to a second portion of the pad.

6. The polishing pad of claim 5, wherein the first portion comprises a first diameter of the pad and the second portion comprises a second diameter of the pad.

7. The polishing pad of claim 5, wherein the first portion comprises a first thickness of the pad and the second portion comprises a second thickness of the pad.

8. A polishing pad for a semiconductor chemical mechanical polishing apparatus comprising a three-dimensional array of particles of abrasive material disposed in a three-dimensional grid of a matrix material, wherein the particles of abrasive material comprise one of the group of, calcium carbonate, alumina silicate, feldspar, calcium sulfate, glass and sintered carbon.

9. A polishing pad for a semiconductor chemical mechanical polishing apparatus comprising a three-dimensional array of particles of abrasive material disposed in a three-dimensional grid of a matrix material, wherein the matrix material comprises one of the group of, poly alkyd, poly vinylester, epoxy and polyester.

10. A chemical mechanical polishing apparatus comprising:

a rotatable platen;

a polishing pad comprising an array of particles of abrasive material disposed in a three-dimensional grid of a matrix material, the particles comprising an inorganic material coated with a coupling agent, the polishing pad being affixed to the platen; and a wafer carrier adapted to force a wafer surface against the polishing pad with a predetermined amount of force.

11. The chemical mechanical polishing apparatus of claim 10, wherein the matrix material comprises a polymeric material.

12. The chemical mechanical polishing apparatus of claim 11, wherein the particles of abrasive material comprise an inorganic material.

13. The chemical mechanical polishing apparatus of claim 11, wherein the polymeric material comprises one of the group of polyurethane, polyurethane, poly alkyd, poly vinylester, epoxy and polyester.

14. The chemical mechanical polishing apparatus of claim 10, wherein the particles of abrasive material comprise one of the group of silica, calcium carbonate, alumina silicate, feldspar, calcium sulfate, glass and sintered carbon.

15. The chemical mechanical polishing apparatus of claim 10, wherein the matrix material comprises polyurethane.

16. The chemical mechanical polishing apparatus of claim 10, wherein the coupling agent is one of the group of organo-silicates, organo-titanates, and organo-zirconates.

17. The chemical mechanical polishing apparatus of claim 10, wherein the distribution of particles of abrasive material per unit volume of matrix material varies from a first portion of the pad to a second portion of the pad.

18. A method of polishing a semiconductor substrate, the method comprising:

providing a rotatable platen;

affixing a polishing pad to the platen;

polishing surfaces of a plurality of semiconductor wafers by consecutively urging each of the semiconductor wafer surfaces against a first surface of the polishing pad so that as the polishing pad wears, a subsequent surface of the polishing pad, containing a different population of abrasive particles, becomes exposed so that a polishing performance of the polishing pad remains uniform throughout the life of the polishing pad, such that no reconditioning of the polishing pad is required when polishing the plurality of the semiconductor wafers surfaces.

19. The method of claim 18, further comprising forming the polishing pad to have a distribution of particles of abrasive material per unit volume of matrix material that varies from a first portion of the pad to a second portion of the pad.

20. A method of polishing a semiconductor substrate, the method comprising:

providing a rotatable platen:

affixing a polishing pad to the platen:

polishing a surface of a semiconductor wafer by urging the semiconductor wafer surface against a first surface of the polishing pad so that as the polishing pad wears, a subsequent surface of the polishing pad, containing a different population of abrasive particles, becomes exposed;

providing a fluid having a first composition to the polishing pad during a first period of polishing; and providing a fluid having a second composition to the polishing pad during a second period of polishing.

* * * * *